US007180398B2

(12) United States Patent
Hoffmann et al.

(10) Patent No.: US 7,180,398 B2
(45) Date of Patent: Feb. 20, 2007

(54) COIL FORMER FOR AN ELECTROMECHANICAL ACTUATOR

(75) Inventors: Ralf Hoffmann, Berlin (DE); Thomas Haehnel, Berlin (DE); Joerg Schultheiss, Bergholz-Rehbruecke (DE); Olaf Abel, Potsdam (DE)

(73) Assignee: Tyco Electronics AMP GmbH, Bensheim (DE)

( * ) Notice: Subject to any disclaimer, the term of this patent is extended or adjusted under 35 U.S.C. 154(b) by 44 days.

(21) Appl. No.: 11/056,015

(22) Filed: Feb. 11, 2005

(65) Prior Publication Data

US 2005/0190034 A1 Sep. 1, 2005

(30) Foreign Application Priority Data

Feb. 11, 2004 (DE) ..... 10 2004 006 712

(51) Int. Cl.
*H01F 27/30* (2006.01)

(52) U.S. Cl. ..... 336/208; 336/198

(58) Field of Classification Search ..... 336/198, 336/208, 192

See application file for complete search history.

(56) References Cited

U.S. PATENT DOCUMENTS

| | | | | |
|---|---|---|---|---|
| 4,639,706 | A * | 1/1987 | Shimizu | 336/170 |
| 5,819,397 | A * | 10/1998 | Knight et al. | 29/605 |
| 5,870,011 | A * | 2/1999 | Mori et al. | 336/90 |

FOREIGN PATENT DOCUMENTS

| | | |
|---|---|---|
| DE | G 1 904 579 | 11/1964 |
| DE | G 84 16 629.0 | 8/1984 |
| DE | 3638152 A1 * | 5/1988 |
| EP | 0 098 887 B1 | 9/1986 |
| GB | 963874 | 7/1964 |

* cited by examiner

*Primary Examiner*—Anh Mai
(74) *Attorney, Agent, or Firm*—Barley Snyder LLC

(57) ABSTRACT

The invention provides a coil former for an electromechanical actuator with a U-shaped yoke, having a base arranged between two limbs and forming a coil core. The coil former comprises a bobbin holder having an opening therein to receive the base portion of the yoke, and delimiting elements flanking the bobbin holder. At least a portion of the coil former is resiliently deformable to connect the coil former onto the base.

8 Claims, 4 Drawing Sheets

COIL FORMER FOR AN ELECTROMECHANICAL ACTUATOR

FIELD OF THE INVENTION

The present invention relates to a coil former for an electromechanical actuator, such as a relay, and in particular to a coil former that is connectable directly onto a base of a U-shaped yoke, which forms a coil core.

BACKGROUND

In the case of a U-shaped relay yoke, in which a base (i.e., horizontal flange) of the yoke simultaneously forms the coil core, the coil former cannot be slipped horizontally onto the base of the U-shaped core after winding. Known solutions comprise a coil former which is fitted perpendicularly. A disadvantage thereof is that the coil former has to be pushed over the pole faces used for armature coupling, whereby particles may become deposited on these pole faces and impair functioning of the magnet system. Another solution consists in dividing the yoke at the base and giving it a two-piece construction, such that the coil former may be fitted onto the base after winding. A disadvantage of this solution is that the joint of the two-piece core may lead to an increase in magnetic resistance and thus to magnetic circuit losses.

An object of the present invention consists in avoiding the disadvantages of the prior art and providing a coil former for an electromagnetic actuator which may be fitted without difficulty directly to the base of the yoke.

SUMMARY

To achieve the forgoing and other objects, and according to an exemplary embodiment, the invention provides a coil former for an electromechanical actuator with a U-shaped yoke, having a base arranged between two limbs and forming a coil core. The coil former comprises a bobbin holder having an opening therein to receive the base portion of the yoke, and delimiting elements flanking the bobbin holder. At least a portion of the coil former is resiliently deformable to connect the coil former onto the base.

The coil former may consist for example of two coil former halves, which may be latched or snapped together. Each coil former half has an opening for receiving the base of the yoke, such that the coil former halves are latched surrounding the base. The two coil former halves may optionally also be connected together by means of a film hinge, such that they may be folded together over the base of the yoke and latched to one another. The two coil former halves in each case comprise mutually corresponding catch means, which allow detachable latching of the coil former halves at their intended position on the yoke. The catch means may for example in each case consist of a catch hook, which is provided to accommodate a catch lug. The catch means are latched by resilient deformation of the material supporting the lug, the hook or both.

In an alternative embodiment of the invention, the coil former is of one-piece construction and may be pushed over the base portion of the yoke by resilient expansion. To this end, the coil former comprises an opening in its circumference, which is preferably expanded during pushing on of the coil former, until the coil former is fitted fully over the yoke and springs back to its original shape.

The coil former according to the invention exhibits the advantage that it is of very simple construction, may be cheaply produced from plastics material and may be fixed without difficulty at positions on a yoke at which a conventional coil former cannot be fitted.

Further features and advantages of the invention are revealed by the dependent claims and the following description of the Figures.

BRIEF DESCRIPTION OF THE DRAWINGS

The invention will now be explained with reference to preferred exemplary embodiments and the attached drawings, in which.

DETAILED DESCRIPTION OF THE EMBODIMENT(S)

Figure 1:
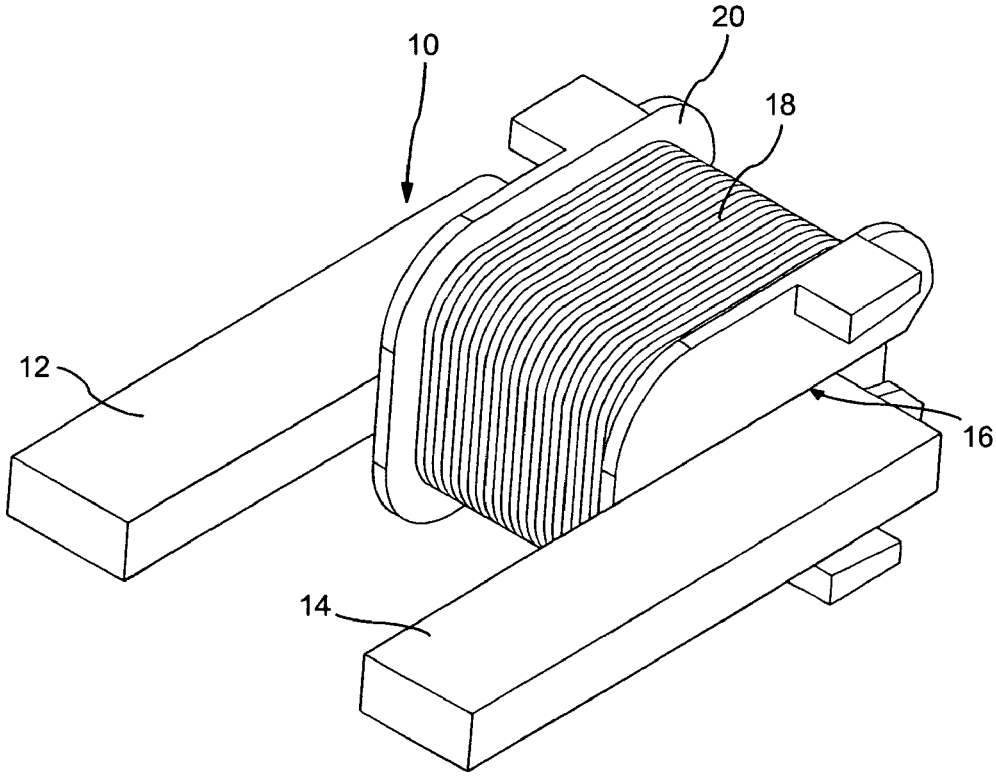
FIGS. 1 and 2 show a coil former according to an exemplary embodiment of the invention, with FIG. 1 being a perspective view of the coil former assembled on a yoke and having a coil formed thereon, and FIG. 2 being a perspective view of the coil former and the yoke prior to assembly.
Figure 2:
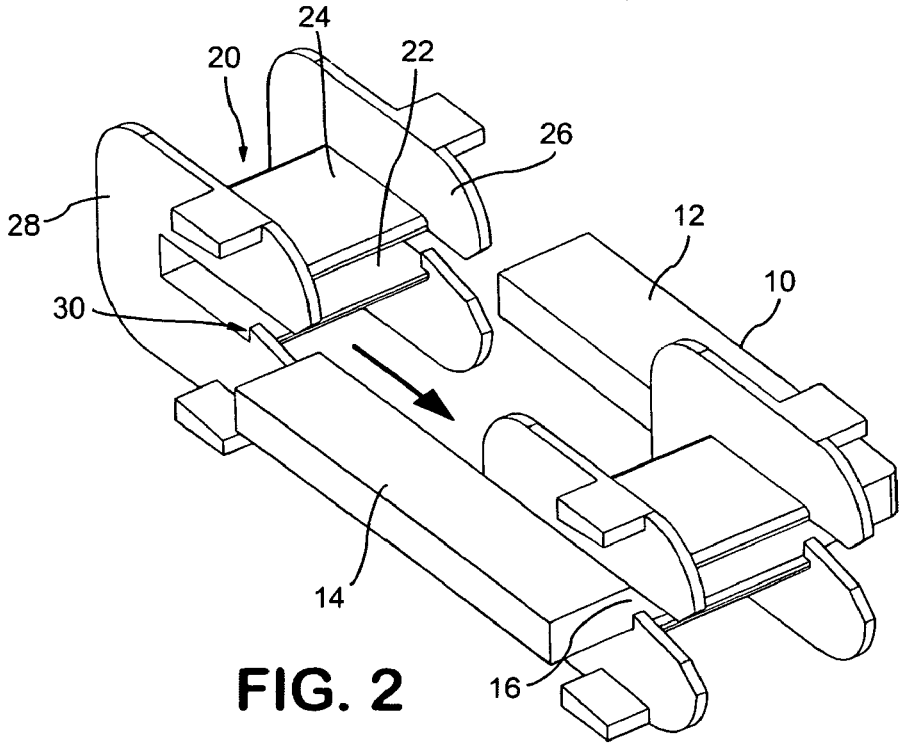

FIG. 1 shows a U-shaped yoke 10 of an electromechanical actuator or a relay, whose base portion 16, arranged between two limbs 12, 14 of the yoke 10, simultaneously forms a coil core for a coil 18 disposed thereon. The coil 18 is wound on a coil former 20 which has been slipped or pushed onto the base portion 16. The illustration shows that the coil former 20 with the coil 18 wound thereon cannot be pushed onto the base portion 16 in the ready-wound state because of the yoke limbs 12 and 14, which are bent in each case by 90 degrees to the base portion 16. As shown in FIG. 2, the coil former 20 according to an exemplary embodiment of the invention may be fitted directly onto the base portion 16 of the yoke 10. For this purpose, the coil former 20 comprises an opening 22 in its circumference, which opening 22 corresponds to the external circumference of the base portion 16 of the yoke 10. In an exemplary embodiment, the coil former 20 comprises a U-shaped bobbin holder 24, the width of which corresponds to the width of the base portion 16 of the yoke 10. The bobbin holder 24 is flanked on both sides of its U-shaped profile by disk-shaped delimiting elements 26, 28, which are advantageously so dimensioned that they project beyond a fully-wound coil 18 at all points. The delimiting elements 26, 28 are in each case arranged perpendicularly to the surface of the bobbin holder 24 and finish in each case flush with the inside surface of the bobbin holder 24, such that the bobbin holder 24 may rest with its inside flat against three sides of the base portion 16 in the assembled state.

The opening 22 extends into the delimiting elements 26, 28. The delimiting elements 26, 28 are bevelled at their edges associated with the opening 22, so that the coil former 20 may be easily pushed onto the yoke. Catch lugs 30 are formed on the delimiting elements 26, 28 adjacent the opening 22, extending partially over the opening 22. Because of the narrowed opening, the U-shaped bobbin holder 24 is bent apart when being pushed onto the yoke 10. As soon as the coil former 20 has been pushed on completely, it snaps back into its starting position and it is held in its intended place on the base portion 16 by the catch lugs 30, functioning as fixing means. Once the coil former 20 has been pushed on in this way, the coil 18 may be wound thereon.

Figure 3:
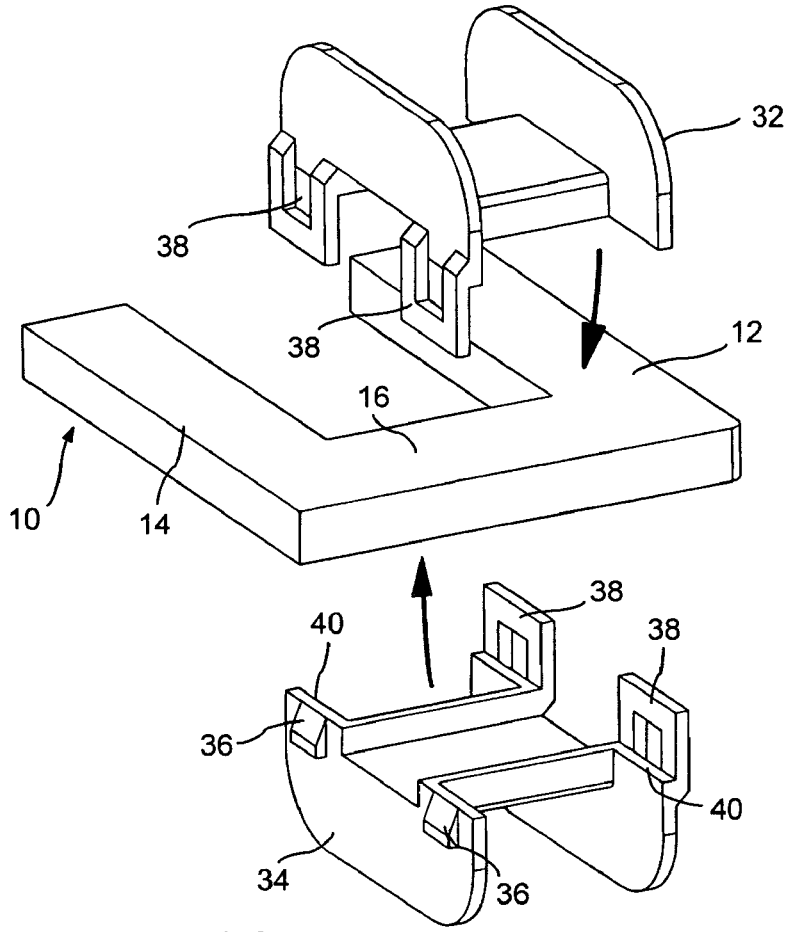
FIGS. 3 and 4 show a coil former according to another exemplary embodiment of the invention, with FIG. 3 being a perspective view of the coil former and a yoke prior to assembly, and FIG. 4 being a perspective view of the coil former assembled on the yoke.
Figure 4:
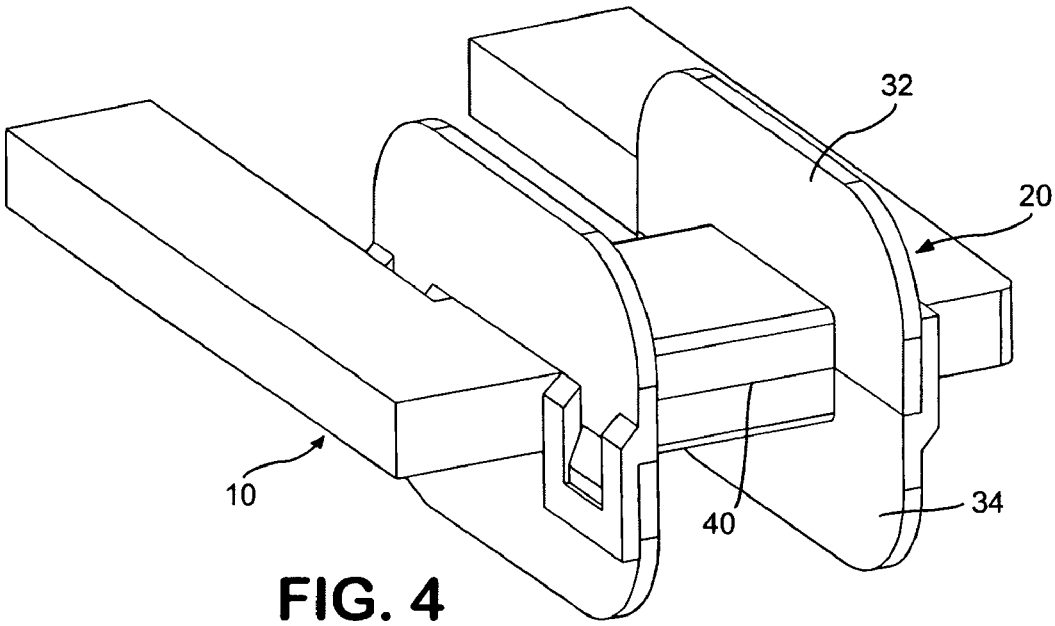

FIG. 3 shows an exploded view of a two-piece coil former 20, whose two coil former halves 32 and 34 may be latched together. The coil former 20 is divided horizontally, forming facing parting edges 40. Each coil former half 32, 34 comprises half of a bobbin holder 24 and half of each of two delimiting elements 26, 28. Each of the coil former halves 32, 34, therefore, comprise an opening where the bobbin holder 24 is divided. Each of the two coil former halves 32, 34 also comprises two catch lugs 36 arranged next to one another, which correspond in each case to corresponding catch lugs 38 on the other coil former half, such that the two coil former halves 32, 34 may latch together without play when the coil former halves 32, 34 are pushed onto the base portion 16 (c.f. FIG. 4).

The two catch connections are in each case arranged at the facing parting edges 40 of the two lateral delimiting elements 26, 28 of the coil former 20. Each coil former half 32, 34 comprises in each case two catch lugs 36 on one delimiting element 26 and two catch hooks 38 on the other delimiting elements 28. The two coil former halves 32, 34 are so configured as to be interchangeable.

Figure 5:
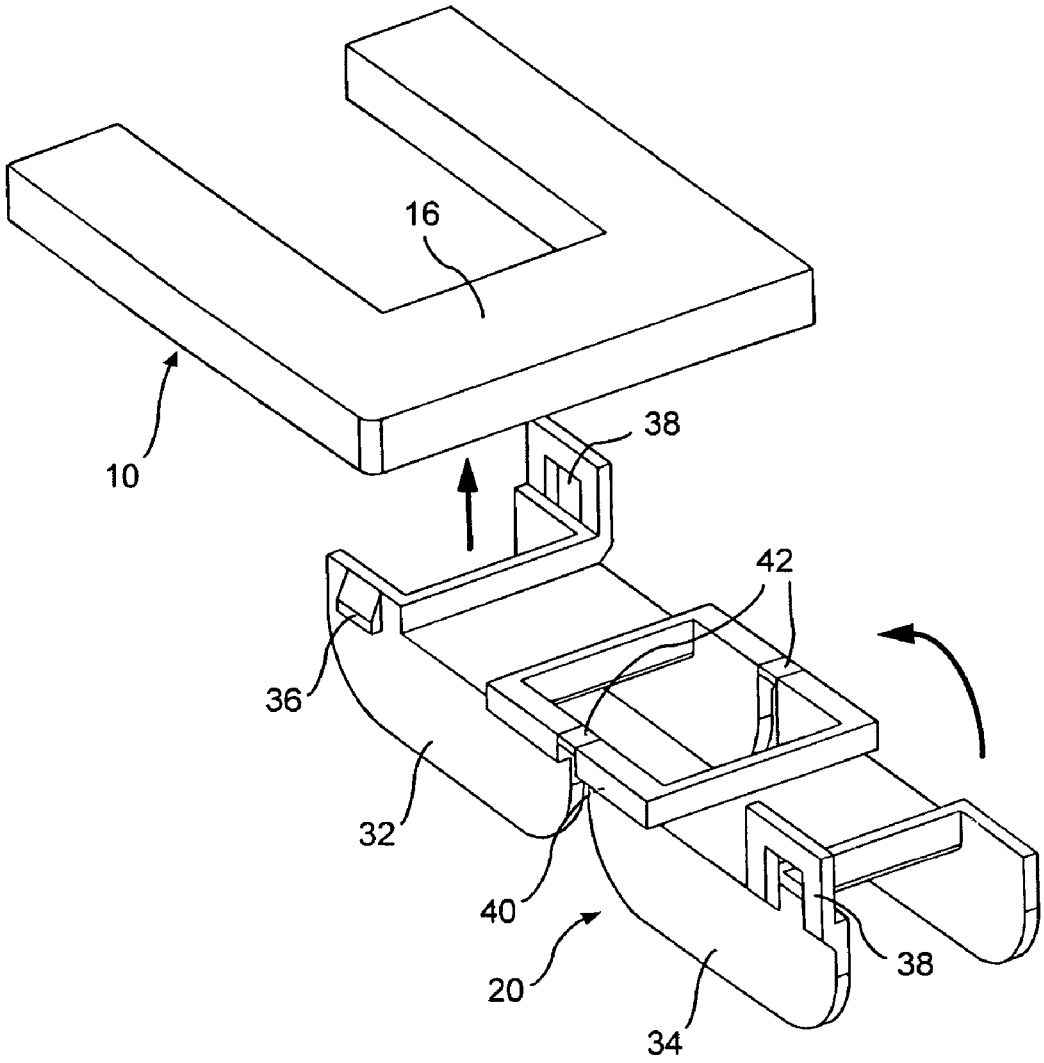
FIGS. 5 to 7 show a coil former according to yet another exemplary embodiment of the invention, with FIG. 5 being a perspective view of the coil former and a yoke prior to assembly, FIG. 6 being a perspective view of the coil former partially assembled on the yoke, and FIG. 7 being a perspective view of the coil former assembled on the yoke.
Figure 6:
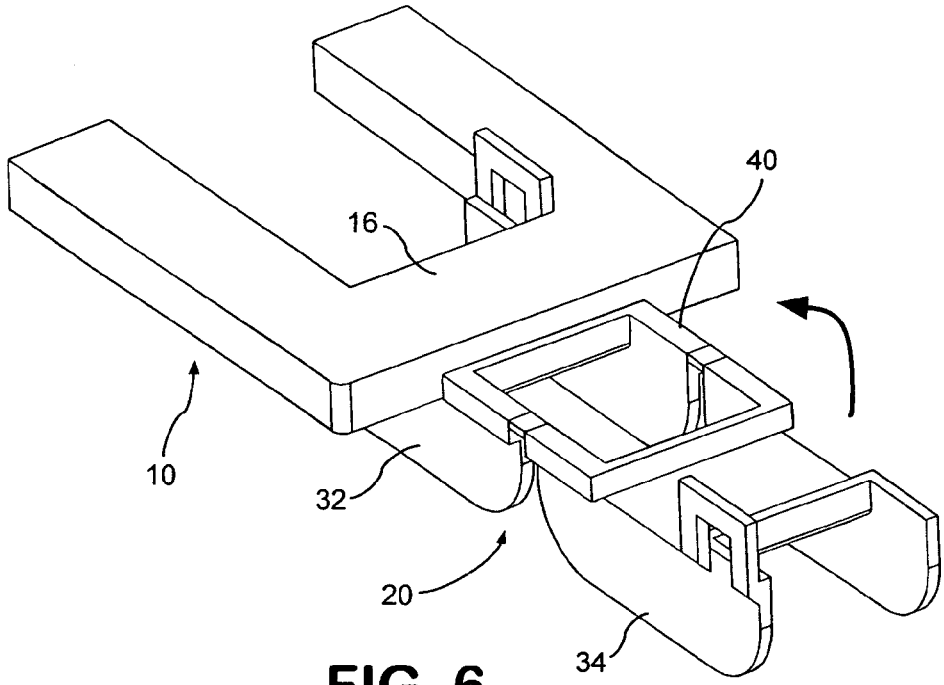
Figure 7:
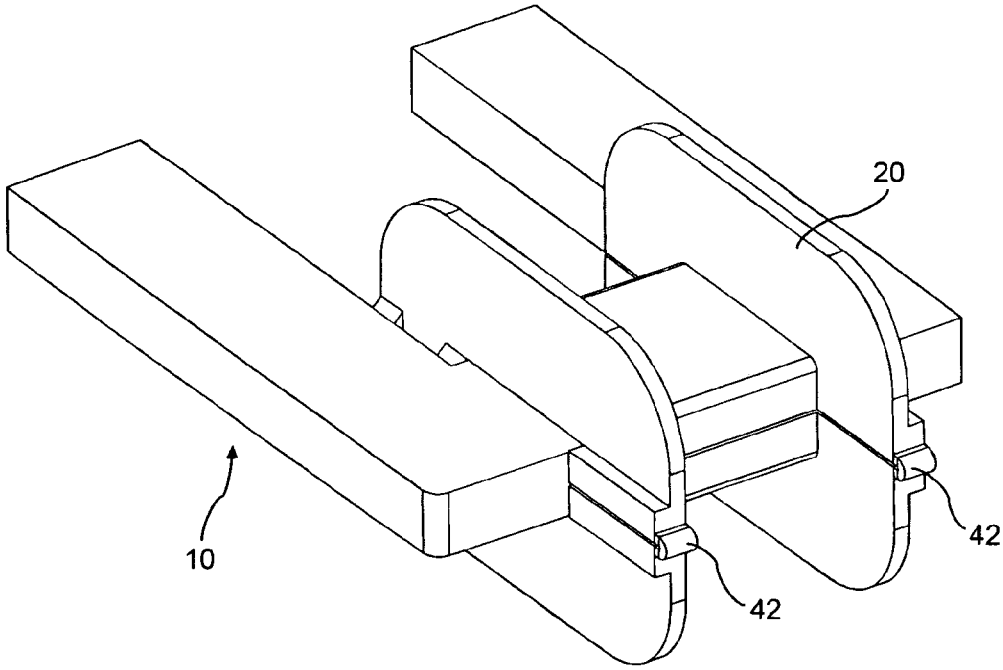

FIGS. 5 to 7 show yet another embodiment of the invention, in which the two coil former halves 32 and 34 are connected together by means of two film hinges 42, such that the coil former 20 may be fitted by one coil former half 32 to the base portion 16 of the yoke 10 (FIG. 6), whereupon the other coil former half 34 may be swivelled through 180 degrees and latched to the first coil former half 32 (FIG. 7).

Here too, a catch lug 36 and a corresponding catch hook 38 are provided in each case, such that the two coil former halves 32 and 34 may be latched together without play.

The two film hinges 42 are in each case located at one end of the parting edges 40 of the delimiting elements 26 resting against one another in the closed state, which elements may be bulkier on the hinge side to provide better stability (see. FIG. 6).

While the invention has been described with reference to the illustrated exemplary embodiments, the invention is not limited by these embodiments. Rather various changes can be made within the scope of the claims. For example, alternate hook and lug arrangements may be provided.

What is claimed is:

1. A coil former for an electromechanical actuator with a U-shaped yoke, having a base portion arranged between two limbs and forming a coil core, the coil former comprising:

two coil former halves which latch together to encompass the base portion, the coil former halves forming a bobbin holder having an opening therein to receive the base portion of the yoke; and delimiting elements flanking the bobbin holder;

at least a portion of the coil former being resiliently deformable to connect the coil former onto the base portion.

2. A coil former according to claim 1, wherein the two coil former halves are connected together by means of at least one film hinge.

3. A coil former according to claim 2, wherein the two coil former halves each comprise mutually corresponding catch means for locking connection and fixing of the two coil former halves on the base portion of the yoke.

4. A coil former according to claim 3, wherein the catch means each comprise a catch lug on one of the coil former halves and a corresponding catch hook on the other of the coil former halves.

5. A coil former according to claim 1, wherein the coil former halves are configured to be interchangeable.

6. A coil former according to claim 1, wherein the bobbin holder is configured to receive a coil.

7. A coil former according to claim 1, wherein an inside surface of the bobbin holder rests flat against the base portion.

8. A coil former according to claim 1, wherein the delimiting elements and the limbs of the U-shaped yoke extend in the same direction.

* * * * *